US005313253A

United States Patent [19]

Martin et al.

[11] Patent Number: 5,313,253

[45] Date of Patent: May 17, 1994

[54] PAPER PATH SIGNATURE ANALYSIS APPARATUS

[75] Inventors: Michael J. Martin; Steve R. Moore; Russell J. Sokac, all of Rochester; Kathleen Laffey, Hamlin; Robert P. Siegel, Penfield; Gerald M. Garavuso, Rochester; Lloyd W. Durfey, Palmyra, all of N.Y.

[73] Assignee: Xerox Corporation, Stamford, Conn.

[21] Appl. No.: 930,258

[22] Filed: Aug. 17, 1992

[51] Int. Cl.[5] ..... G03G 21/00; G03G 15/00

[52] U.S. Cl. ..... 355/205; 355/203; 355/204; 355/209; 271/256; 271/258; 364/478; 364/222.6; 364/917.5; 364/DIG. 2

[58] Field of Search ..... 355/203-206, 355/208-209, 308, 309, 316; 271/202, 199, 152-156, 256, 258, 270, 122; 346/18; 364/474.09, 474.12, 474.3, 474.35, 478, 565, 222.6-222.7, 226, 917.5-917.6, 917.9; 324/160, 161

[56] References Cited

U.S. PATENT DOCUMENTS

| | | | |
|---|---|---|---|
| 4,072,415 | 2/1978 | Inoue et al. | 355/210 |
| 4,166,615 | 9/1979 | Noguchi et al. | 271/259 |
| 4,203,586 | 5/1980 | Hoyer | 271/34 |
| 4,379,987 | 4/1983 | Kohzai et al. | 364/474.3 X |
| 4,386,305 | 5/1983 | Kohzai et al. | 364/474.12 X |
| 4,416,534 | 11/1983 | Kluger | 355/208 X |
| 4,519,700 | 5/1985 | Barker et al. | 271/258 X |
| 4,541,709 | 9/1985 | Kampschreur | 355/208 X |
| 4,541,711 | 9/1985 | Takahashi | 355/208 |
| 4,892,426 | 1/1990 | Steele | 250/560 X |
| 4,940,224 | 7/1990 | Cooper | 271/263 |
| 4,975,741 | 12/1990 | Tanaka | 355/206 |
| 5,028,965 | 7/1991 | Kinoshita et al. | 355/308 X |
| 5,097,273 | 3/1992 | Moro et al. | 271/258 X |
| 5,101,232 | 3/1992 | Evans et al. | 355/208 |
| 5,122,964 | 6/1992 | Hayashi et al. | 364/474.35 X |
| 5,130,748 | 7/1992 | Tanaka | 355/206 |
| 5,185,627 | 2/1993 | Hartman | 355/204 |
| 5,197,726 | 3/1993 | Nogami | 271/270 X |
| 5,204,726 | 4/1993 | Choi | 355/208 X |
| 5,210,578 | 5/1993 | Saito et al. | 355/208 X |
| 5,235,392 | 8/1993 | Hediger | 355/203 X |

*Primary Examiner*—Matthew S. Smith

[57] ABSTRACT

A sheet path velocity profile signature analysis apparatus which utilizes output from various idler rolls throughout the machine paper path to detect abnormalities. The constantly monitored and instantaneous velocity readings are compared with a base line velocity signature established at the factory. If the constantly monitored velocity profile is not within the pre-established operating parameters as set at the factory, automatic machine adjustment procedures are initiated and/or automatic service alerts are issued. The ability to constantly monitor the velocity profile throughout the machine enables preventative maintenance to occur and worn drive rolls, idler rolls and other transport devices can be replaced before catastrophic failure.

19 Claims, 3 Drawing Sheets

PAPER PATH SIGNATURE ANALYSIS APPARATUS

This invention relates generally to a paper path analysis apparatus, and more particularly concerns an apparatus to track and record velocity characteristics of paper transport idler rolls to establish a paper path velocity profile in an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In an electrophotographic printing machine, as described above, it is important that sheets be properly registered at various stages of the electrophotographic process. Many modern machines use a crossed roll registration system to side register sheets as they pass through a machine. These systems are generally reliable except when drive or idler rolls begin to wear excessively or become contaminated. If the machine controller logic were able to determine the ability of sheets to register, the parameters of optimum registration performance could be developed and monitored during machine operation.

It is desirable to have the ability to monitor the position of a sheet of paper within an electrophotographic printing machine for jam detection paper position information, roll slipping and timing adjustments within the machine. It is further desirable to have continuous updates on paper velocity thereby enabling jam detection almost instantaneously. This also allows the detection of paper slipping in a feeder or a transport. The ability to monitor the paper velocity throughout the entire paper path within the printing machine enables a velocity signature of the entire path to be established. Using a base line signature and constantly monitoring the signature throughout the machine's use can be used for failure analysis and preventive maintenance. Furthermore, automatic adjustment of various machine parameters can be accomplished by monitoring the velocity signature.

The following disclosures may be relevant to various aspects of the present invention:

U.S. Pat. No. 4,940,224, Patentee-Couper, Issue Date-Jul. 10, 1990;

U.S. Pat. No. 4,203,586, Patentee-Hoyer, Issue Date-May 20, 1980;

U.S. Pat. No. 4,166,615, Patentee-Noguchi et ano, Issue Date-Sep. 4, 1979,

The relevant portions of the foregoing disclosures may be briefly summarized as follows:

U.S. Pat. No. 4,940,224 discloses a sheet separator utilizing a clutched idler roll in circumferential contact with the drive roll, the idler roll rotation being monitored by an encoder. The speed of the idler roll and the drive roll is compared and used to detect sheet misfeeds, double-feeds and jams.

U.S. Pat. No. 4,203,586 describes a multifeed detection system which includes a drag roll in contact with and loaded against a feed belt. In the event of a double sheet entering the nip between the drag roll and the feed belt, the drag roll will hesitate. This hesitation is detected by a sensor.

U.S. Pat. No. 4,166,615 discloses a jam detector which monitors the speed of an idler roll and compares it with the speed of the contacting drive roll to detect jams.

In accordance with one aspect of the present invention, there is provided an apparatus for monitoring the velocity profile of sheet paper handling machines. The apparatus comprises means for advancing a sheet and means for measuring the velocity profile of the advancing means and generating a signal indicative thereof. Means for comparing the signal from the measuring means with a reference signal to generate an error signal are also provided.

Pursuant to another aspect of the present invention, there is provided a method for monitoring the performance of a sheet handling device. The method comprises the steps of advancing a sheet and measuring the velocity profile of the sheet. The steps of generating a signal indicative of the velocity profile and comparing the signal with a reference signal to generate an error signal are also provided.

Pursuant still to another aspect of the present invention, there is provided an electrophotographic printing machine wherein the velocity of the sheet handling device is monitored. The improvement comprises means for advancing a sheet and means for measuring the velocity profile of the advancing means and generating a signal indicative thereof. Means for comparing the signal from the measuring means with a reference signal to generate an error signal are also provided.

Other features of the present invention will become apparent as the following description proceeds and upon reference to the drawings, in which.

While the present invention will be described in connection with preferred embodiments thereof, it will be understood that it is not intended to limit the invention to these embodiments. On the contrary, it is intended to cover all alternatives, modifications, and equivalents as may be included within the spirit and scope of the invention as defined by the appended claims.

Figure 3:
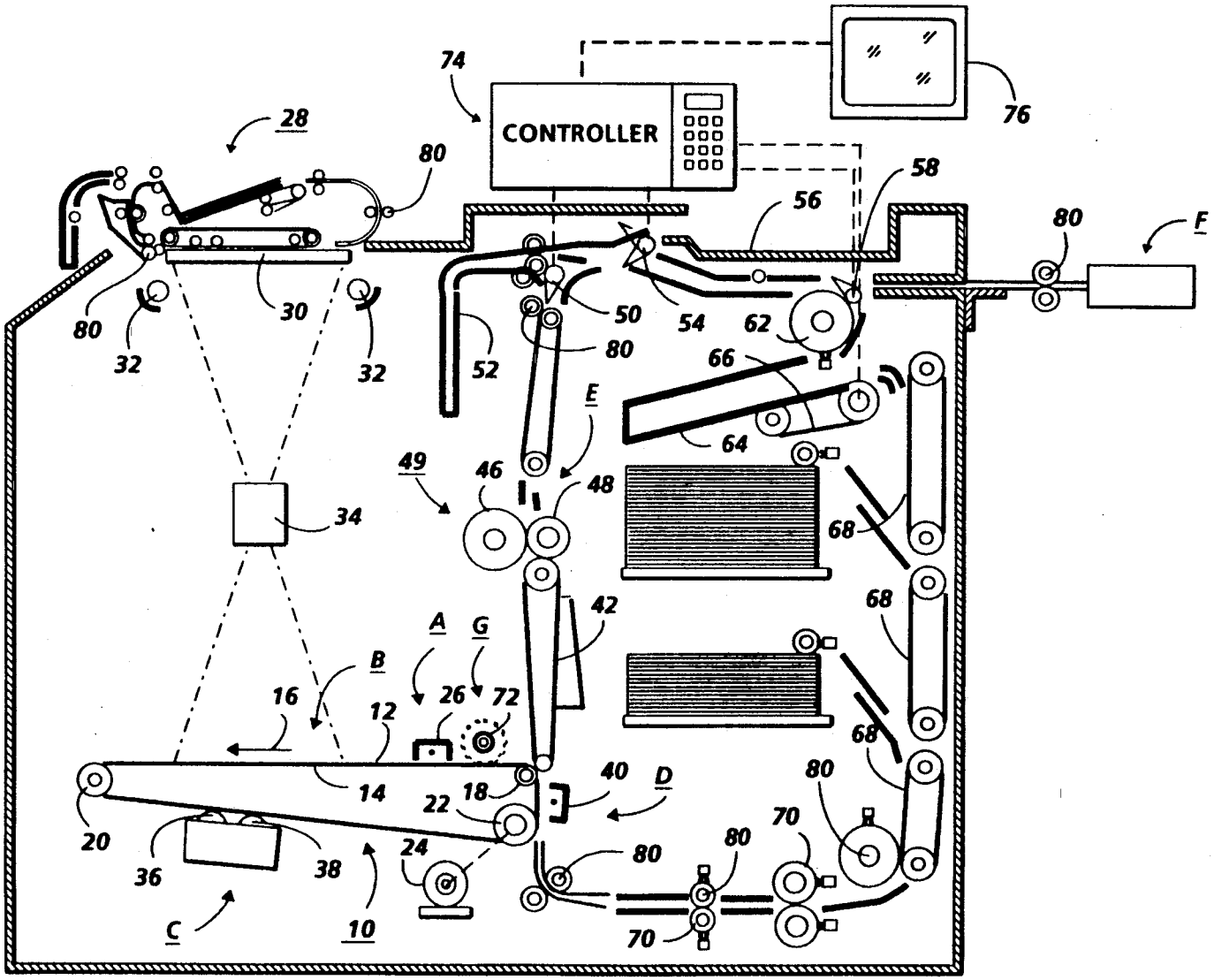
FIG. 3 is a schematic elevational view depicting an illustrative electrophotographic printing machine incorporating the paper path signature analysis apparatus of the present invention therein.

For a general understanding of the features of the present invention, reference is made to the drawings. In the drawings, like reference numerals have been used to identify identical elements. FIG. 3 schematically depicts an electrophotographic printing machine incorporating the features of the present invention therein. It will become evident from the following discussion that the paper path signature analysis apparatus of the present invention may be employed in a wide variety of machines and is not specifically limited in its application to the particular embodiment depicted herein.

Referring to FIG. 3 of the drawings, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Other suitable photoconductive materials and conductive substrates may also be employed. Belt 10 moves in the direction of arrow 16 to advance successive portions of photoconductive surface 12 sequentially through the various processing stations disposed about the path of movement thereof. Belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of photoconductive surface 12 passes through charging station A. At charging station A, a corona generating device, indicated generally by the reference numeral 26, charges photoconductive surface 12 to a relatively high, substantially uniform potential.

Next, the charged portion of photoconductive surface 12 is advanced through imaging station B. At imaging station B, a document handling unit, indicated generally by the reference numeral 28, is positioned over platen 30 of the printing machine. Document handling unit 28 sequentially feed documents from a stack of documents placed by the operator face up in a normal forward collated order in the document stacking and holding tray. A document feeder located below the tray forwards the bottom document in the stack to a pair of take-away rollers. The bottom sheet is then fed by the rollers to a feed roll pair and belt. The belt advances the document to platen 30. After imaging, the original document is fed from platen 30 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 32 which illuminate the document on platen 30. Light rays reflected from the document are transmitted through lens 34. Lens 34 focuses light images of the original document onto the charged portion of photoconductive surface 12 of belt 10 to selectively dissipate the charge thereon. This records an electrostatic latent image on photoconductive surface 12 which corresponds to the informational area contained within the original document. Thereafter, belt 10 advances the electrostatic latent image recorded on photoconductive surface 12 to development station C.

At development station C, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station D.

Prior to reaching transfer station D, a copy sheet is placed in proper lateral edge alignment. At transfer station D, a copy sheet is moved into contact with the toner powder image. Transfer station D includes a corona generating device 40 which sprays ions onto the backside of the copy sheet. This attracts the toner powder image from photoconductive surface 12. After transfer, conveyor 42 advances the copy sheet to fusing station E.

Fusing station E includes a fuser assembly, indicated generally by the reference numeral 49, which permanently affixes the transferred toner powder image to the copy sheet. Preferably, fuser assembly 49 includes a heated fuser roller 46 and a back-up roller 48 with the powder image on the copy sheet contacting fuser roller 46. In this manner, the powder image is permanently affixed to the copy sheet.

After fusing, the copy sheets are fed to gate 50 which functions, as an inverter selector. Depending upon the position of gate 50, the copy sheets are deflected to sheet inverter 52 or bypass inverter 52 and are fed directly to a second decision gate 54. At gate 54, the sheet is in a face-up orientation with the image side, which has been fused, face up. If inverter path 52 is selected, the opposite is true, i.e. the last printed side is face down. Decision gate 54 either deflects the sheet directly into an output tray 56 or deflects the sheet to decision gate 58. Decision gate 58 may divert successive copy sheets to duplex inverter roll 62, or onto a transport path to finishing station F. At finishing station F, copy sheets are stacked in a compiler tray and attached to one another to form sets. The sheets are attached to one another by either a binding device or a stapling device. In either case, a plurality of sets of documents are formed in finishing station F. When decision gate 58 diverts the sheet onto inverter roll 62, roll 62 inverts and stacks the sheets to be duplexed in duplex tray 64. Duplex tray 64 provides an intermediate or buffer storage for those sheets that have been printed on one side and on which an image will be subsequently printed on the second, opposed side thereof, i.e. the sheets being duplexed. The sheets are stacked in duplex tray face down on top of one another in the order in which they are copied.

In order to complete duplex copying, the simplex sheets in tray 64 are fed, in seriatim, by bottom feeder 66 from tray 64 back to transfer station D via conveyors 68 and rollers 70 for transfer of the toner powder image to the opposed sides of the copy sheets. Inasmuch as successive bottom sheets are fed from duplex tray 64, the proper or clean side of the copy sheet is positioned in contact with belt 10 at transfer station D so that the toner powder image is transferred thereto. The duplex sheet is then fed through the same path as the simplex sheet to be stacked in tray 56 or, when the finishing operation is selected, to be advanced to finishing station F.

Invariably, after the copy sheet is separated from photoconductive surface 12 of belt 10, some residual particles remain adhering thereto. These residual particles are removed from photoconductive surface 12 at cleaning station G. Cleaning station G includes a rotatably mounted fibrous or electrostatic brush 72 in contact with photoconductive surface 12 of belt 10. The particles are cleaned from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. The paper path signature analysis apparatus of the present invention can be utilized to keep track of the position of the documents and the copy sheets. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex or duplex copy sheets to the compiler tray at finishing station F. The detailed operation of paper path signature analysis apparatus 80 will be described hereinafter with reference to FIGS. 1A through 2, inclusive.

It is believed that the foregoing description is sufficient for purposes of the present application to illustrate the general operation of an electrophotographic printing machine. Referring now to the specific subject matter of the present invention, FIGS. 1A, 1B and 2 depict the paper path signature analysis apparatus in greater detail.

Figure 1A:
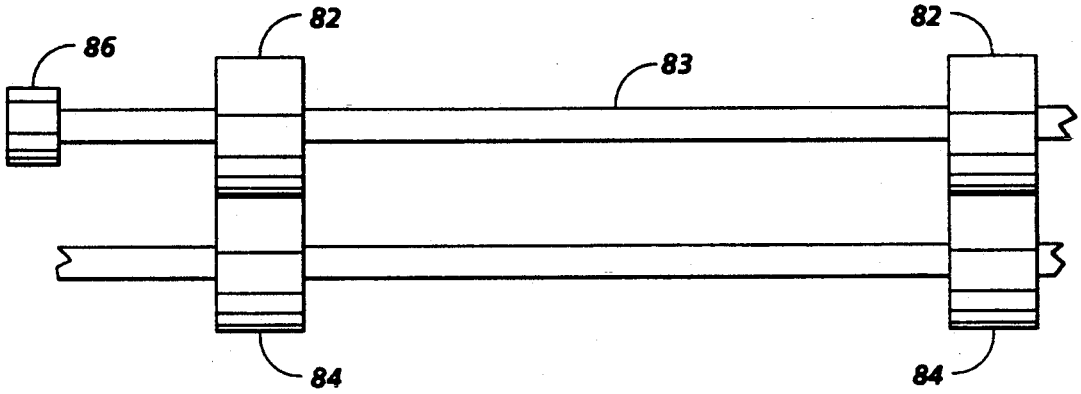
FIG. 1A is an elevational view of one embodiment of the velocity monitoring device of the paper path signature analysis apparatus of the present invention.
Figure 1B:
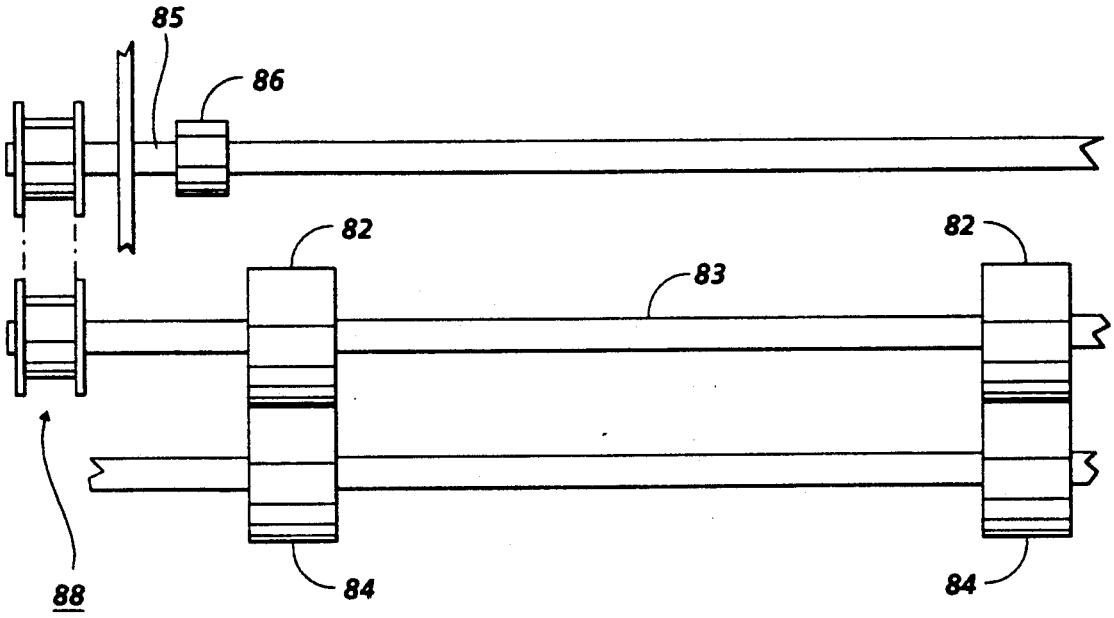
FIG. 1B is an elevational view of a second embodiment of the velocity monitoring device.

With reference to FIGS. 1A and 1B, there is shown two embodiments of the idler roll velocity monitoring device 80. In each instance there is a pair of idler rolls 82 in circumferential frictional contact with a pair of drive rolls 84 forming a nip therebetween through which sheets will pass so that rotational velocity of the idler roll 82 will equal the sheet velocity through the paper path. In FIG. 1A, a drum-type encoder 86 is mounted directly to the idler roll shaft 83 so as to rotate at the same rotational velocity as the idler shaft 83 and the idler rolls 82 which are fixedly attached to the shaft 83. In FIG. 1B, a drive belt arrangement generally indicated by reference numeral 88 causes the idler roll shaft 83 to be connected to the encoder shaft 85 thereby enabling the encoder 86 to monitor the rotational velocity of the idler roll shaft 83 and rolls 82. In this arrangement the encoder velocity may be equal to or some known function of the idler velocity depending on the drive pulley ratio. It has been found that the encoder should be of a low mass with regard to the idler rolls and shaft so as to allow for a more sensitive reading. If the encoder has too large a mass, it effectively acts as a flywheel and damps out slight variations in idler speed which may be crucial to determining wear of components and/or other malfunctions within the paper path. The encoders can be mounted to various idlers throughout the paper paths in the printing machine. The idler roll encoder may also be used in combination with a transport belt as well as a drive roll. It is also possible to use an idler roll that has an encoder built into it as an integral portion thereof. Initially, upon manufacture at the factory, a velocity reading at each point throughout the paper path can be made and stored in the machine controller memory. A base line paper path velocity signature profile can be established and a window of proper operating parameters can then be set up. Throughout the useful life of the machine the velocity at each point throughout the paper path can be constantly monitored and that information fed to the machine controller. The controller can compare the monitored velocities with the machine base line velocity signature from the factory and assure that the machine is operating within its designed parameters. The machine may also be able to self-adjust various idler roll normal forces and other machine processes as wear causes the monitored velocities to approach the limit of proper operating parameters. Timing and drive characteristics may also be automatically adjusted in response to the monitored data.

It is also possible to utilize the various velocity readings from the machine paper path to predict failures and to alert operators and service technicians of needed preventative maintenance. It is even possible to cause the machine to automatically alert service technicians of an impending failure based on variations in the sheet velocity. As an additional feature, paper jams and misfeeds can be detected and automatic machine procedures for shut down can be initiated based on the velocities as monitored. For example, in the event of a jam, the idler roll will stop while the drive roll continues to drive. The monitored zero idler velocity can then be used to thereby alert the machine controller that there are sheets jammed in the nip.

Figure 2:
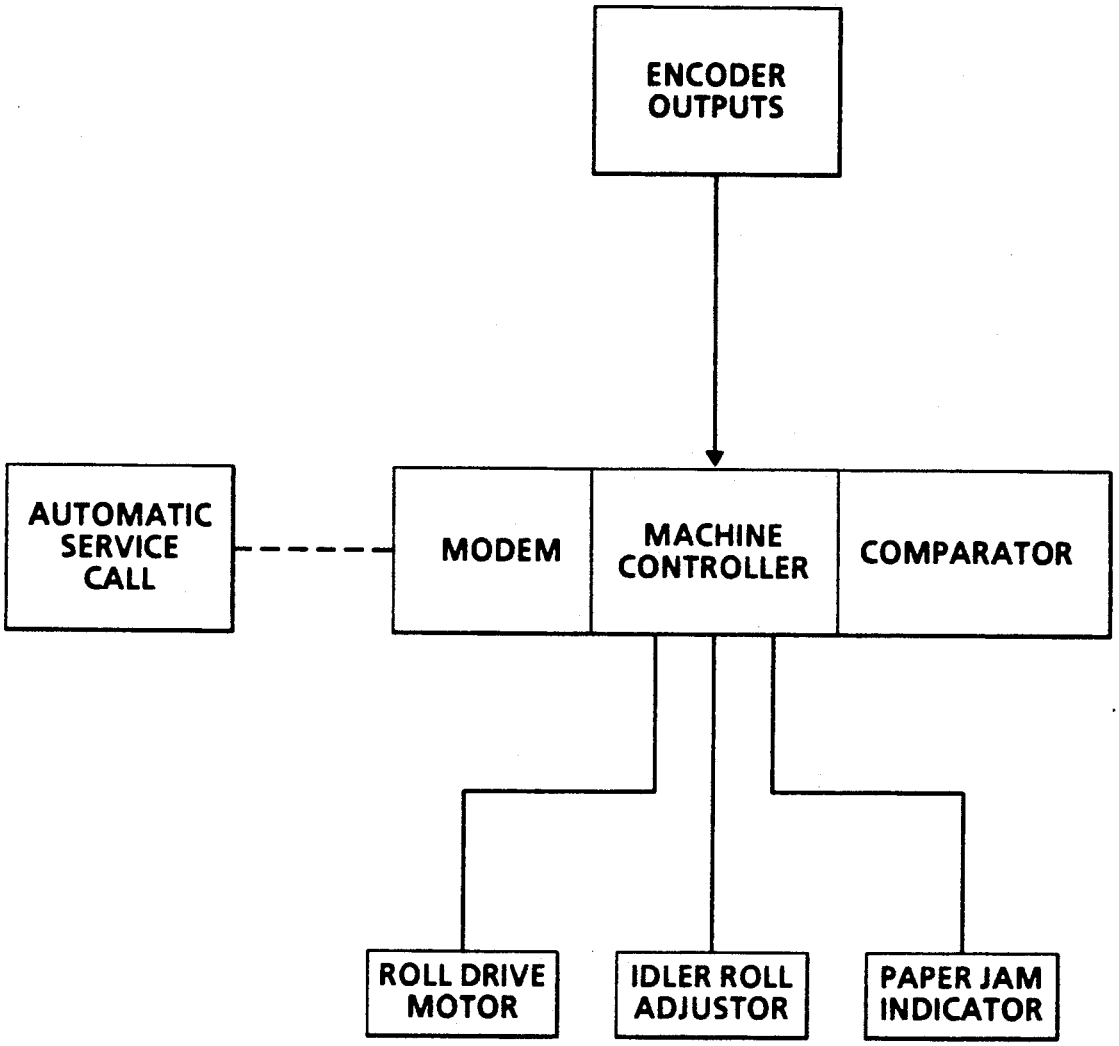
FIG. 2 is a flow diagram illustrating the implementation of the paper path signature analysis apparatus herein.

FIG. 2 illustrates a general block diagram of a flow chart utilizing the encoder output to the machine controller. The encoder outputs from each of the idler rolls are passed to the machine controller which then compares each of these outputs with the base line velocity signature profile established at the factory. If this overall velocity profile is within the operating parameters as set at the factory, no adjustments are made. Should one or more of the velocities detected at the various points throughout the paper path or paths differ significantly from the base line velocity signature profile, either normal force adjustment to idler rolls can be made, drive roll motors can be adjusted or stopped accordingly, and paper jam indicators specifying the positions of such jams can be activated to signal the problem to the operator. A video display 76 can be utilized to specifically pinpoint the location of the jam and to instruct in the clearing of the jam. Also, by incorporating a modem in cooperation with the machine controller, an automatic service feature can be initiated wherein service personnel can be alerted to impending idler roll failure and/or other problems within the paper transport system based on variation of the velocity profile with respect to the factory base line profile.

In recapitulation, there is provided a paper path velocity signature analysis apparatus which utilizes output from various idler rolls throughout the machine paper path to detect abnormalities. The constantly monitored and instantaneous velocities readings are compared with a base line velocity signature established at the factory. If the constantly monitored velocity profile is not within the pre-established operating parameters as set at the factory, automatic machine adjustment procedures are initiated and/or automatic service alerts are issued. The ability to constantly monitor the velocity profile throughout the machine enables preventative maintenance to occur and worn drive rolls, idler rolls and other transport devices can be replaced before catastrophic failure, thereby satisfying the end user.

It is, therefore, apparent that there has been provided in accordance with the present invention, a paper path signature analysis apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for monitoring the velocity of a sheet handling device for advancing individual cut sheets, comprising:

means for advancing individual cut sheets independently of and relative to one another;

means for measuring a velocity profile of said advancing means as individual sheets are advanced thereby and generating a signal indicative thereof; and means for comparing the signal from said measuring means with a reference signal to generate an error signal.

2. The apparatus of claim 1, further including means, in response to the error signal, for displaying a fault message.

3. The apparatus of claim 1, wherein said comparing means comprises a programmable machine controller.

4. An apparatus for monitoring the velocity of a sheet handling device for advancing individual cut sheets, comprising:

means for advancing individual cut sheets independently from one another, wherein each said advancing means comprises a drive roller and an idler roller in frictional contact with said drive roller defining a nip therebetween;

means for measuring a velocity profile of said advancing means as individual sheets are advanced thereby and generating a velocity profile signal indicative thereof;

means for comparing the signal from said measuring means with a reference signal to generate an error signal; and means, in response to the error signal, for displaying a fault message.

5. The apparatus of claim 4, wherein each said measuring means comprises an encoder connected to said idler roller, said encoder generating the velocity profile signal as a function of the rotational speed of the idler roller with the velocity profile signal being transmitted from said encoder to said comparing means.

6. The apparatus of claim 5, wherein said comparing means comprises a programmable machine controller.

7. An apparatus for monitoring the velocity of a sheet handling device for advancing individual cut sheets, comprising:

means for advancing individual cut sheets independently of and relative to one another, each said advancing means comprising a drive roller, and an idler roller in frictional contact with said drive roller defining a nip therebetween;

means for measuring a velocity profile of said advancing means as individual sheets are advanced thereby and generating a velocity profile signal indicative thereof; and means for comparing the signal from said measuring means with a reference signal to generate an error signal.

8. The apparatus of claim 7, wherein each said measuring means comprises an encoder connected to said idler roller, said encoder generating the velocity profile signal as a function of the rotational speed of the idler roller with the velocity profile signal being transmitted from said encoder to said comparing means.

9. The apparatus of claim 8, wherein said comparing means comprises a programmable machine controller.

10. An electrophotographic printing machine of the type for advancing individual cut sheets through the machine, wherein the velocity of the sheet handling device is monitored comprising:

means for advancing individual cut sheets independently of and relative to one another;

means for measuring a velocity profile of said advancing means as individual sheets are advanced thereby and generating a signal indicative thereof; and means for comparing the signal from said measuring means with a reference signal to generate an error signal.

11. The printing machine of claim 10, further including means, in response to the error signal, for displaying a fault message.

12. The printing machine of claim 10, wherein said comparing means comprises a programmable machine controller.

13. An electrophotographic printing machine of the type for advancing individual cut sheets through the machine, wherein the velocity of the sheet handling device is monitored comprising:

means for advancing individual cut sheets independently from one another, wherein each said advancing means comprises a drive roller and an idler roller in frictional contact with said drive roller defining a nip therebetween;

means for measuring a velocity profile of said advancing means as individual sheets are advanced thereby and generating a velocity profile signal indicative thereof;

means for comparing the signal from said measuring means with a reference signal to generate an error signal; and means, in response to the error signal, for displaying a fault message.

14. The printing machine of claim 13, wherein each said measuring means comprises an encoder connected to said idler roller, said encoder generating the velocity profile signal as a function of the rotational speed of the idler roller with the velocity profile signal being transmitted from said encoder to said comparing means.

15. The printing machine of claim 14, wherein said comparing means comprises a programmable machine controller.

16. An electrophotographic printing machine of the type for advancing individual cut sheets through the machine, wherein the velocity of the sheet handling device is monitored comprising:

means for advancing individual cut sheets independently of and relative to one another each said advancing means comprising a drive roller, and an idler roller in frictional contact with said drive roller defining a nip therebetween;

means for measuring a velocity profile of said advancing means as individual sheets are advanced thereby and generating a velocity profile signal indicative thereof; and means for comparing the signal from said measuring means with a reference signal to generate an error signal.

17. The printing machine of claim 16, wherein each said measuring means comprises an encoder connected to said idler roller, said encoder generating the velocity profile signal as a function of the rotational speed of the idler roller with the velocity profile signal being transmitted from said encoder to said comparing means.

18. The printing machine of claim 17, wherein said comparing means comprises a programmable machine controller.

19. The printing machine of claim 18 further comprising means for automatically adjusting machine operating parameters in response to the generated velocity profile signal.

* * * * *